US005842299A

United States Patent [19]

Switzer et al.

[11] Patent Number: 5,842,299

[45] Date of Patent: Dec. 1, 1998

[54] REVOLVER CARTRIDGE LOADER

[76] Inventors: Robert D. Switzer, deceased, late of Ft. Thomas, Ky.; by Deborah L. Switzer, executrix, 2200 N. Ft. Thomas Ave., Ft. Thomas, Ky. 41075

[21] Appl. No.: 807,376

[22] Filed: Feb. 27, 1997

[51] Int. Cl.[6] ..... F41A 9/82

[52] U.S. Cl. ..... 42/89; 42/88

[58] Field of Search ..... 42/88, 89

[56] References Cited

U.S. PATENT DOCUMENTS

| | | | |
|---|---|---|---|
| 1,480,812 | 1/1924 | Bazan | 42/89 |
| 1,655,624 | 1/1928 | Nelson | 42/89 |
| 1,964,171 | 6/1934 | Pflaume | 42/89 |
| 2,896,353 | 7/1959 | Hunt | 42/89 |
| 2,944,359 | 7/1960 | Hanley | 42/89 |
| 3,722,125 | 3/1973 | Switzer | 42/89 |
| 4,079,536 | 3/1978 | Hunt | 42/89 |
| 4,202,124 | 5/1980 | Switzer | 42/89 |
| 4,313,275 | 2/1982 | Switzer | 42/89 |
| 4,866,870 | 9/1989 | Johnson | 42/89 |

*Primary Examiner*—Charles Jordan
*Assistant Examiner*—Meena Chelliah
*Attorney, Agent, or Firm*—Wood, Herron & Evans

[57] ABSTRACT

A cartridge loader for a revolver, the loader having a casing with a series of cartridge bores located on a bore circle locus of points having a larger diameter then the chamber circle locus of points for the revolver. The casing's bores preferably each have two flatted side wall portions that aid in defining the tubular wall of the bore, one of the flatted wall portions of each cartridge bore being adjacent one of the flatted side wall portions of an adjacent cartridge bore.

26 Claims, 3 Drawing Sheets

REVOLVER CARTRIDGE LOADER

This invention relates to cartridge loaders. More particularly, this invention relates to cartridge loaders for revolvers.

Cartridge loaders are, of course, very well known to the art. Cartridge loaders of one structure or another have been around for many, many years, and are shown in the early patent art as well as the recent patent art. One type of cartridge loader structure in the commercial market place is designed particularly for use with revolvers. Revolvers are normally loaded by hand, the normal six chambers of a revolver's cylinder being manually loaded one cartridge at a time. Basically, a cartridge loader functions to retain the six cartridges temporarily in storage. When reloading of the revolver is required, the cartridge loader with stored cartridges is interposed in operational relation with the revolver's cylinder, and all six cartridges are released simultaneously into that cylinder. Quite obviously, the concept of a cartridge loader materially increases the speed with which a revolver can be loaded and reloaded, and greatly facilitates the loading and reloading of that revolver, by a user. Revolver cartridge loaders that have seen significant commercial success in the market place are those illustrated in U.S. Pat. Nos. 3,722,125, 4,202,124 and 4,313,275, all invented by the inventor of the improved revolver cartridge loader of this application.

Now in the past, the commonplace revolver in the market place has been a six shooter, i.e., the revolver's cylinder has had six chambers which hold six cartridges. But today it is possible to make revolvers with cylinders having seven chambers. A seven chamber revolver is achieved simply by altering a revolver's six chamber cylinder to add one more chamber. This may result in a revolver cylinder with thinner chamber walls, and is believed possible because of new metal technology that provides metals strong enough to make the cylinder walls thinner between the cartridge chambers. Indeed, by adding one more chamber to a six chamber revolver cylinder in order to form a seven chamber revolver cylinder, the heads of the cartridges held by the cylinder may now be separated by only several thousandths of an inch.

The kind of revolver cartridge loaders known to the prior art that have seen commercial success in the market place, and that are referred to above in this application, are problematical for use with the seven chamber cylinder revolvers. This for the reason that the prior art six cartridge loaders have significantly larger cartridge bores to accommodate the cartridges than do the cartridge chambers in the prior art six chamber revolver cylinders. Such larger cartridge bores in the cartridge loader are needed so that the cartridges held in that loader can be easily dropped from the loader into the revolver cylinder's cartridge chamber when reloading of the revolver is desired. So a six cartridge revolver loader of the prior art that is simply reformed to provide seven cartridge bores on the same circular bore locust of points previously used for six cartridge bores would result in no wall at all between the cartridge bores and this, of course, would result in an unworkable loader.

Accordingly, it has been a primary objective of this invention to provide a revolver cartridge loader with at least one of uniquely positioned and uniquely shaped cartridge bores so that cartridges held by the loader will drop from the loader into a revolver cylinder's chambers with ease and without binding when reloading of the revolver is desired.

It has been another objective of this invention to provide a unique star-shaped latch rotatably carried in a revolver cartridge loader's casing, the star points of the latch preferably each having a cam surface on the leading edge thereof that cooperates with a cartridge's head flange to bias that cartridge into a captured position with a cartridge bore as the latch rotates from its release position to its capture position.

In accord with these objectives, the improved revolver cartridge loader of this invention is adapted to cooperate with a revolver having a cylinder with a series of cartridge chambers. The revolver's chambers are located on a chamber circle locus of points having a first diameter. The cartridge loader includes a casing with a series of cartridge bores which, in preferred form, are located on a bore circle locus of points having a second diameter, that second diameter being greater than the first diameter of the chamber circle locus of points. Also in preferred form, each of the casing's cartridge bores comprise two flatted wall portions that aid in defining the tubular wall of the cartridge bore, one of the flatted wall portions of each cartridge bore being adjacent one of the flatted side wall portions of an adjacent cartridge bore, this structural configuration allowing the cartridges to be stored in the cartridge loader in cartridge bores that are located closer one to the other on the bore circle locus of points than would be otherwise possible if the cartridge bores were circular in cross-section as per the prior art. In other words, this cartridge bore configuration for the loader allows the cartridge bores themselves to be placed closer together on a bore circle locust of points while maintaining the structural integrity and strength of the cartridge loader's casing then would be otherwise possible if the bores were of the prior art circular cross-sectional configuration. A second novel feature of this invention is the configuration of the generally star-shaped latch rotatably carried with the loader's casing for holding the cartridges in temporary stored relation with the loader. The star-shaped latch includes a series of star points and, in preferred form, the star points each have a cam surface on the leading edge thereof that cooperates with a cartridge's flange to bias that cartridge into its final captured position within its cartridge bore as the latch rotates from its release position back to its capture position. This cam action function of the latch's star points aids in insuring that the cartridges, upon reloading the cartridge loader, are all in proper capture position with the loader's casing after the star shaped latch is rotated to the capture position even if the cartridges were not perfectly aligned within the cartridge bores initially before the latch was rotated to the capture position.

Further objectives and advantages of this invention will be more apparent from the following detailed description taken in conjunction with the drawings in which.

Figure 4:
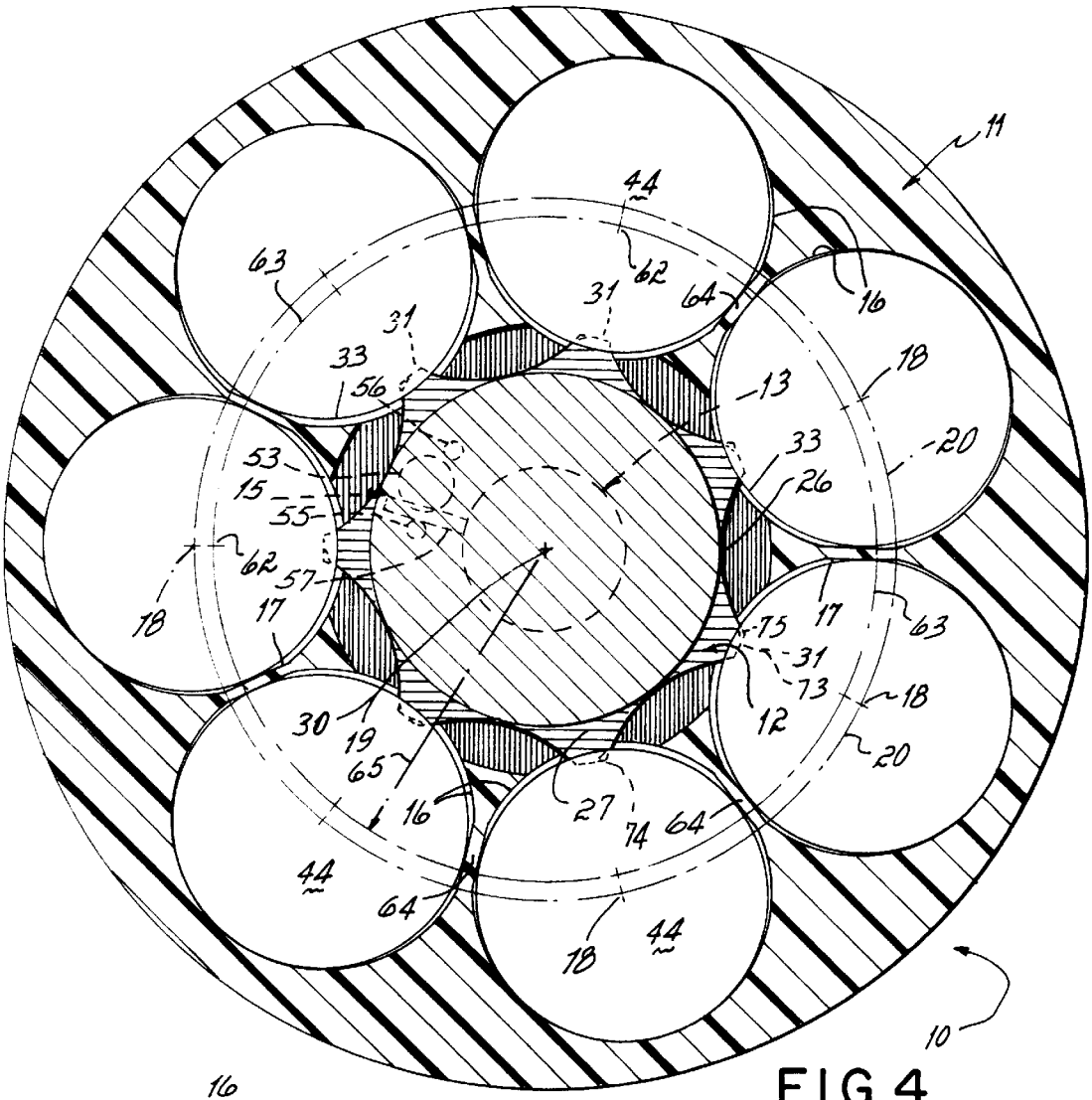
FIG. 4 is a transverse cross-sectional view taken along line 4—4 of FIG. 3.

The improved cartridge loader 10 of this invention basically comprises a casing 11, a star shaped latch 12 on a center post 13 rotatably disposed within that casing, a resilient bore closure member 14, and an over center type limit stop 15 that defines the rotational limits for the centerpost. The casing 11 itself is comprised of seven cartridge throughbores 16 as illustrated in FIG. 4. The seven throughbores 16 are each of the same diameter (except for flatted areas 17 as described in detail below), and each define a longitudinal center axis 18. The bore axes 18 are disposed parallel one to the other, and parallel to the casing's longitudinal axis 19. The center axes 18 of the cartridge bores 17 are disposed on a circular locus 20 of points having as its center the center axis 19 of the casing 11. The casing 11 also includes a center or bearing bore 21 adapted to receive the centerpost 13 in rotational relation therewith. Note that the length L of the casing is significantly less than the length L' of each cartridge to be temporarily stored therein, thereby causing the cartridge's shafts to extend beyond bottom end face 22 of the casing, see FIG. 1. Further, the diameter D of each of the casing's cartridge bores is only very slightly greater than the diameter D' of the each of the cartridge's end flanges, see FIG. 4A.

The loader's centerpost 13 is comprised of a bearing shaft 25, a star-shaped latch shaft 26 (i.e., a latch shaft that is star-shaped in cross-sectional configuration), a latch groove 27 above latch shaft, a washer seat 28, and a knob 29, all being fixed integral one with another and formed from the same material piece, and all being symmetrically disposed on centerpost axis 30 that is co-axial with the casing's longitudinal axis 19. Specifically, the bearing shaft 25 is received in bearing relation with bearing bore 21 of the casing 11 so as to permit rotation of the centerpost 13. The star ribs 31 of the latch shaft 26 are dimensioned, relative to the location of the cartridge bores 16 in the casing 11, so as to intersect or be positioned within those cartridge bores when the latch 12 (and centerpost 13) is disposed in the capture position shown in FIGS. 3 and 4, and so as to be removed from or positioned out of those cartridge bores when the latch (and centerpost) is in the release position (not shown).

The top ends 32 of the star ribs 31 terminate in latch groove 27, the ribs and latch groove being particularly sized and configured to cooperate with the tubular sidewalls of cartridge bores 16 for capturing flanges 33 of cartridges 34, thereby temporarily storing the cartridges within the cartridge loader 10 as discussed in greater detail below, see FIG. 3. the centerpost 13 also defines an inverted seat 35 sized to receive the resilient bore closure member 14 in seated relation thereon. The free end of the centerpost 13 includes knob 29 which has a knurled surface, the knob permitting the centerpost 25 and, hence, the latch 12, to be rotated between capture and release positions by manually gripping the knurled surface thereof.

The resilient but stationary bore closure member 14 includes a washer section 36 with central bore 37 sized to permit interengagement of that washer section with inverted seat 35 on the centerpost 25. The fit between the bore closure member's central bore 37 and the centerpost 25 is a slip fit, and is sized to permit rotation of the centerpost 25 relative to that bore closure member 14. The bore closure member 14 is comprised of seven resilient protective arms 38 which are structured to cooperate with seven cartridge bores 16 in the casing 11. The protective arms 38 each extend outwardly from washer section 36 so as to permit substantially independent resilience or flex action of each arm relative to the bore 16 served by that arm. Note the washer section 36 abuts top end face 39 of the casing 11, and is thereby trapped in inverted seat 35. In this assembled relationship with the casing 11, each protective arm's downturned finger 40 extends into one of the casing's cartridge bores 16. Since the width W of each downturned finger 40 is less than the diameter D of its associated bore, see FIGS. 2 and 4A, and since the fingers extend slightly down into the bores 16, see FIG. 3, the bore closure member 14 cannot rotate with the centerpost 25, i.e., the bore closure member is held stationary, when the latch 12 is rotated or moved between its capture and release positions.

Figure 1:
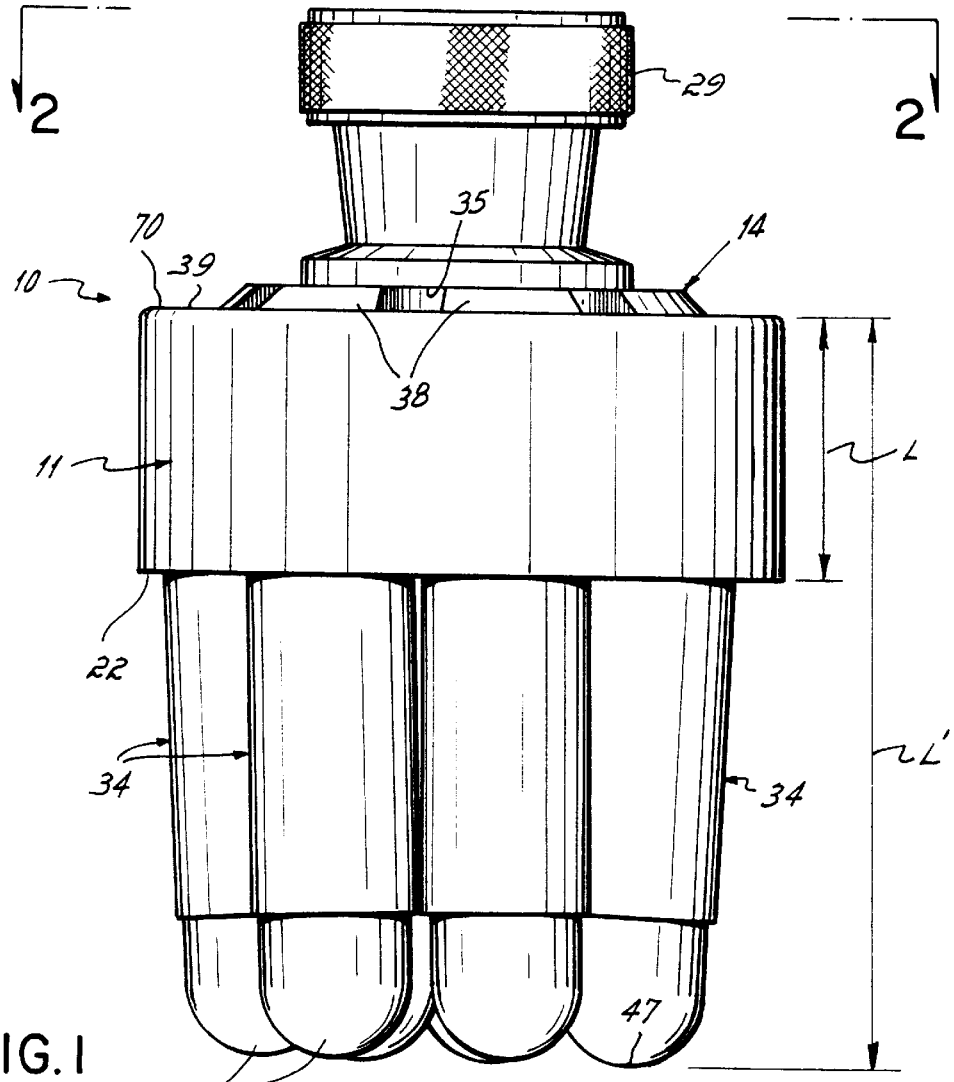
FIG. 1 is a side elevational view illustrating an improved revolver cartridge loader in accord with the principles of this invention, the loader being illustrated with a cartridge load in temporary stored or captured relation therewith.
Figure 2:
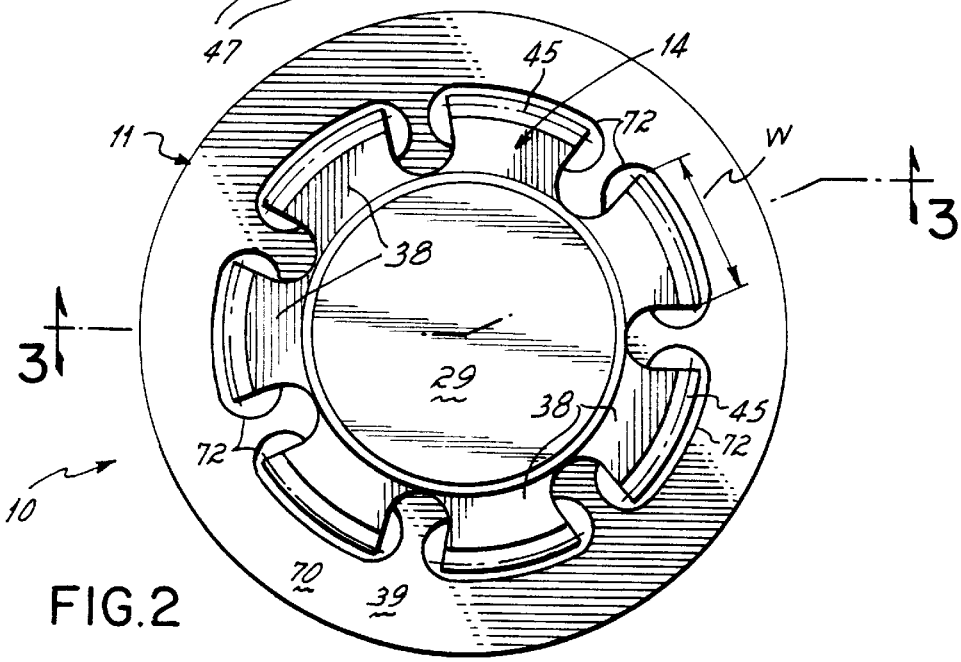
FIG. 2 is a top view of the loader illustrated in FIG. 1, and taken along line 2—2 of FIG. 1.
Figure 3:
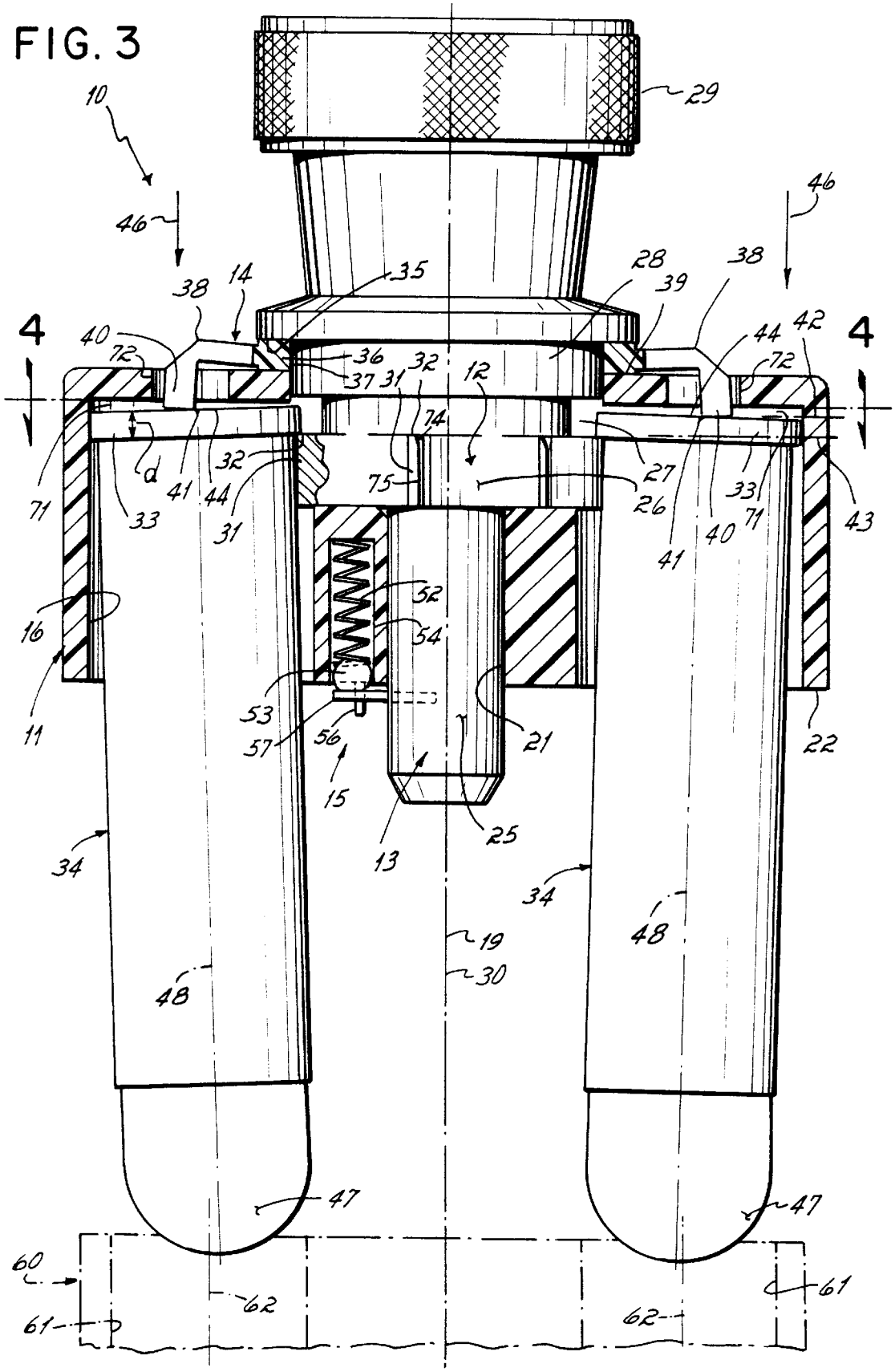
FIG. 3 is a longitudinal cross-sectional view taken along line 3—3 of FIG. 2.

The contact surface 41 of each protective arm's finger 40 is biased slightly upwardly and lies in a common plane 42 transverse to the loader's axis 30 when cartridges 34 are loaded therein, see phantom line position of the fingers as shown in FIG. 3. This finger contact plane 42 is spaced above lower latch groove plane 43, i.e., above the plane transverse to loader axis 30 on which cartridge flanges 33 rest, a distance lesser than the cartridge flange depth d so the fingers' contact surfaces 41 always contact the top surfaces 44 of the cartridge flanges when the loader 10, with a full load of cartridges 34, is upright and motionless as shown in FIGS. 1 and 3. Further, the protective arms' fingers 40 are located on a circular locus 45 of points disposed radially outward (relative to the center axis 19 of the casing) of the circular locus 20 of points defined by the casing bores' axes 18 when the loader is viewed from the top thereof, see FIGS. 2 and 4. This structural relation ensures that a downward spring-type or resilient force (as represented by force lines 46) will be presented by the protective arms' fingers 40 on the flanges 33 of cartridges 34 temporarily stored within the loader 10 when the loader is upright and motionless as shown in FIG. 3. This spring or resilient force ensures a slight drooping of the cartridge's nose ends 47 toward the loader's axis 30, i.e., forces the cartridges axes 48 to cock slightly inward as shown in FIG. 3 when the loader 10 is upright and motionless. The spring-type downward contact provided by this relationship between the protective arms' fingers 40 and the cartridges' flanges 33 when the loader 10 is upright and motionless is for purposes explained in greater detail below. Preferably the resilient closure member 14 is fabricated of an inherently resilient material, e.g., polyethylene, of a one-piece configuration. The loader's casing 11 also includes an end cap 70 that at least partially closes the top ends 71 of the loader's cartridge bores 16. The end cap defines an arcuate slot 72 located over each cartridge bore 16, that slot being sized and configured to allow a resilient arm 38 to extend through same into operative relation with a cartridge's end flange 33, all as shown in FIG. 2. The end cap 70 on the loader's casing 11 cooperates with that casing to enhance its structural integrity in light of the thin walled webs 64 between adjacent cartridge bores 16 in the casing as established by those bores' flatted wall portions 17.

The over center limit stop device 15 restrains the centerpost 13, protective arms 38 and casing 11 in operational relation, and cooperates to define the capture and release positions of the star-shaped latch 12 relative to the casing, i.e., cooperates to ensure that the latch (and, hence, the centerpost) is either disposed in the capture position illustrated in FIGS. 3 and 4 or the release position (not shown), respectively. The limit stop device 15 includes a spring 52 loaded ball 53 received in longitudinal bore 54 disposed parallel to the casing's axis 19. The device 15 also includes stop pins 55, 56 embedded in the casing 11, and disposed on either side of the ball 53, which cooperate with a cross pin 57 fixed to the centerpost 13 and disposed radially therefrom, see FIG. 4. The relation of the cross pin 57, and the stop pins 55, 56, with the ball 53 is such that, because of the loading of the ball's spring 52, the cross pin (and, hence, the latch 12 and centerpost 13) is disposed in either the cartridge capture position shown in FIGS. 3 and 4, or the cartridge release position (not shown). The spring 52 bias of the ball 53 tends to force the cross pin 57, and thereby rotate the latch 12, into either the capture or release position once the cross pin passes the ball's center upon manual rotation of the centerpost 13 through use of the knob 29, thereby establishing an over-center type structure and function.

Now the aspects of a revolver cartridge reloader 10 of the type described above, and to which this invention is directed, are two. First there is the structural configuration of the loader's casing 16. And second, there is the structural configuration of the loader's star latch 12.

Figure 4A:
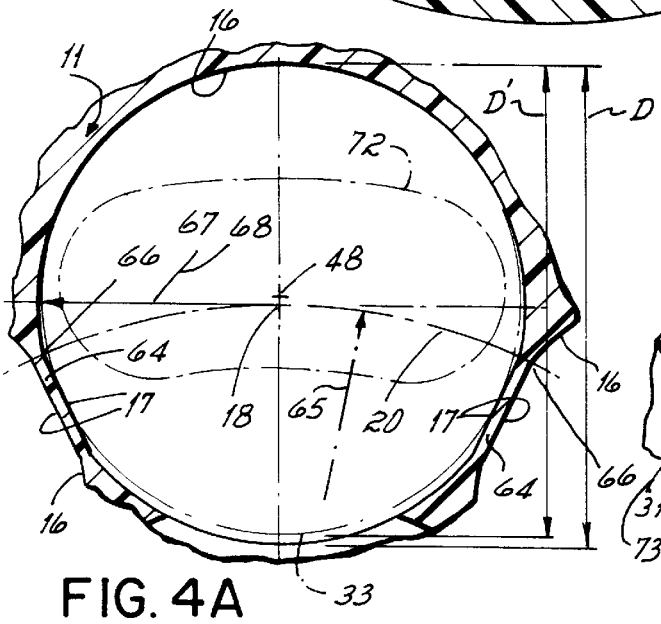
FIG. 4A is an enlarged view of encircled portion 4A of FIG. 4.
Figure 5:
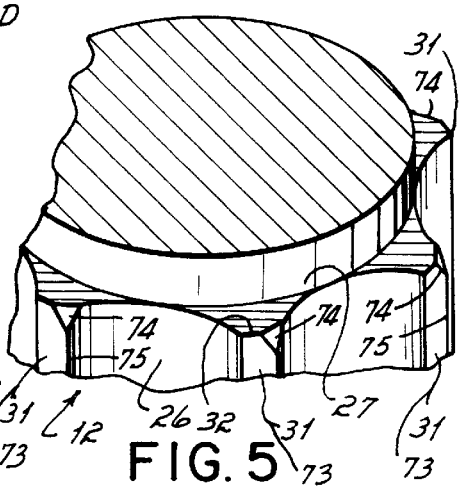
FIG. 5 is a perspective view showing a star point of the loader's star latch.

With respect to the loader's casing bores 16, and as particularly illustrated in FIGS. 3 and 4, the loader is adapted for use with a revolver having a cylinder 60 with a series of seven cartridge chambers 61. Each of those cylinder cartridge chambers 61 defines a center axis 62 which, when viewed in end view, is located on a chamber circle locus 63 of points having a first diameter. Also in this regard, the casing's cartridge bores 16 each define a center axis 18 which when viewed in top view is located on a bore circle locus 20 of points having a second diameter. The revolver cylinder's cartridge chamber circle locus 63 of points of a first diameter is less then the loader's cartridge bore circular locus 20 of points of a second diameter. In other words, the cartridge bore circle locus 20 of points is of a greater diameter than the cartridge chamber circle locus 63 of points. Now further, and as particularly illustrated in FIGS. 4 and 4A, note each cartridge bore 16 in the loader's casing 11 is partially defined by two flatted wall portions 17 which are opposite one to the other relative to that casing bore. In this regard, note that the flatted wall portions 17 of adjacent cartridge bores 16 are adjacent one to the other with a thin material web 64 therebetween. Each flatted side wall portion 17 of each cartridge bore 16, when viewed in top view as shown in FIGS. 4 and 4A, is approximately on a phantom radius line 65 of the casing. Further, and again when viewed in top view as shown in FIGS. 4 and 4A, the outer end 66 of each flatted wall portion 17 is proximately ended on the cartridge bores' circle locus 20 of points. Now this cartridge bore 16 structural configuration, i.e., this configuration with a pair of flatted wall portions 17 that cooperate to define each cartridge bore's peripheral or tubular wall, is such that the diameter of the cartridge bore is preserved as illustrated along a line 67 which is tangent to the cartridge bore's circular locus 20 of points at a location where a mid-point radius line 68 from the casing's center intersects that circular locus 20. In effect, therefor, the flatted wall portions 17 of each cartridge bore 16 cause the cartridge 34 to cock or cant along this phantom diameter line 67 as shown in FIGS. 3 and 4A so that even though the cartridge bore's peripheral wall is not fully circular the cartridge can still easily drop out of that bore while remaining in the cocked or canted attitude as it drops simply because the cartridge's flange 33 is slightly pivoted about flange axis 68 so as to allow the flange to clear the bore's flatted portions as it drops out of the casing into a revolver's cartridge chamber 61. In other words, and in use, the cartridges 34 do not drop out of the loader's casing 11 with the cartridge axes 48 directly and coaxially aligned with the cartridge bores' axes 18. Instead they drop out of the loader's casing 11 with the cartridge axes 48 slightly cocked relative to the axes 18 of the casing's cartridge bores 16, and relative to the axes 62 of the revolver cylinder's cartridge chambers 61. And this canted or cocked drop of the cartridges 34 from the loader's casing 11 is ensured by virtue of the loader's resilient arms 38 providing an initial push out of the casing when the star-shaped latch 12 is moved to a release position. This entire structural configuration allows seven cartridge bores 16 to be accommodated on a relatively small circular locus 20 of points in the loader's casing 11 so as to serve seven cartridge chambers 61 in the revolver's cylinder 60.

The second novel aspect of the improved revolver cartridge loader 10 of this invention is the star-shaped latch 12 itself. Each star point 73 on the latch 12 is provided with a cam surface 74 on the leading edge 75 thereof relative to the capture position of the loader 10. This cam surface 74 on the leading edge 75 of each star point 73 cooperates with a cartridge's flange 33 to bias that cartridge into its capture position with the casing's cartridge bore 16 as the latch 12 rotates from its release position to its capture position. And this cam surface 74, in light of potential binding problems that might occur upon reloading the loader with a new load of cartridges 34, tends to ensure that the cartridge flange 33, and therefor the cartridge itself, will be latched into temporary stored configuration within the loader's casing 11.

It is claimed:

1. A cartridge loader for a revolver, said cartridge loader comprising a casing with a series of cartridge bores, each of said bores having a tubular wall, at least one flatted side wall portion partially defining said tubular wall of at least one cartridge bore, and a generally star-shaped latch rotatably carried within said casing, said cartridge bores being circumferentially positioned around said latch, said latch being adapted to cooperate with said cartridge bores for alternately capturing cartridges in and releasing cartridges from said cartridge bores upon rotation of said latch.

2. A cartridge loader as set forth in claim 1, when viewed in top view said flatted wall portion proximately being on a phantom radius line of said casing.

3. A cartridge loader as set forth in claim 2, when viewed in top view the outer end of said flatted wall portion proximately ending on a bore circle locus of points defined by said cartridge bores.

4. A cartridge loader as set forth in claim 1, said casing comprising at least one flatted wall portion partially defining the tubular wall of each of two adjacent cartridge bores, said two flatted side wall portions being adjacent one to the other.

5. A cartridge loader as set forth in claim 4, when viewed in top view the outer end of each flatted wall portion proximately ending on a bore circle locus of points defined by said cartridge bores.

6. A cartridge loader as set forth in claim 1, said casing comprising two flatted side wall portions partially defining the tubular wall of each cartridge bore, one of said flatted side wall portions of each cartridge bore being adjacent one of said flatted side wall portions of an adjacent cartridge bore.

7. A cartridge loader as set forth in claim 6, when viewed in top view each of said flatted wall portions proximately being on a phantom radius line of said casing.

8. A cartridge loader as set forth in claim 7, when viewed in top view the outer end of each flatted wall portion proximately ending on a bore circle locus of points defined by said cartridge bores.

9. A cartridge loader as set forth in claim 8, said loader comprising seven cartridge bores.

10. A cartridge loader as set forth in claim 1, said loader comprising a series of resilient arms connected to said casing, said arms being adapted to bias the noses of cartridges captured in said casing toward said casing's center axis.

11. A cartridge loader as set forth in claim 10, each of said resilient arms being adapted to cooperate with a cartridge's end flange.

12. A cartridge loader as set forth in claim 11, said casing comprising an end cap connected to said casing, said end cap at least partially closing the top ends of said cartridge bores.

13. A cartridge loader as set forth in claim 12, said end cap comprising a cap slot located over each cartridge bore, each of said resilient arms being adapted to extend through a cap slot into operative relation with a cartridge's end flange.

14. A cartridge loader as set forth in claim 13, said loader comprising seven cartridge bores.

15. A cartridge loader for a revolver, said revolver having a cylinder with a series of cartridge chambers, each of said chambers defining a center point which when viewed in end view is located on a cartridge chamber circle locus of points having a first diameter, said cartridge loader comprising a casing with a series of cartridge bores, each of said cartridge bores defining a center point which when viewed in top view is located on a cartridge bore circle locus of points having a second diameter, said second diameter of said cartridge bore circle being greater than said first diameter of said cartridge chamber circle, and a generally star-shaped latch rotatably carried within said casing, said cartridge bores being circumferentially positioned around said latch, said latch being adapted to cooperate with said cartridge bores for alternately capturing cartridges in and releasing cartridges from said cartridge bores upon rotation of said latch.

16. A cartridge loader as set forth in claim 15, said loader comprising a series of resilient arms connected to said casing, said arms being adapted to bias the noses of cartridges captured in said casing toward said casing's center axis.

17. A cartridge loader as set forth in claim 16, each of said resilient arms being adapted to cooperate with a cartridge's end flange.

18. A cartridge loader as set forth in claim 16, said loader comprising seven cartridge bores.

19. A cartridge loader as set forth in claim 15, said casing comprising at least one flatted side wall portion partially defining the tubular wall of at least one cartridge bore.

20. A cartridge loader as set forth in claim 19, said casing comprising two flatted side wall portions partially defining the tubular wall of each cartridge bore, one of said flatted side wall portions of each cartridge bore being adjacent one of said flatted side wall portions of an adjacent cartridge bore.

21. A cartridge loader as set forth in claim 20, said loader comprising seven cartridge bores.

22. A cartridge loader as set forth in claim 19, when viewed in top view said flatted side wall portion proximately being on a phantom radius line of said casing.

23. A cartridge loader as set forth in claim 19, said casing comprising at least one flatted side wall portion partially defining the tubular wall of each of two adjacent cartridge bores, said two flatted side wall portions being adjacent one to the other.

24. A cartridge loader as set forth in claim 23, when viewed in top view, both said flatted side wall portions proximately being on phantom radius lines of said casing.

25. A cartridge loader comprising a casing with a series of cartridge bores, and a generally star-shaped latch rotatably carried within said casing, said latch having a series of star points that cooperate with said cartridge bores for alternately capturing cartridges in and releasing cartridges from said cartridge bores upon rotation of said latch, and a cam surface on the leading edge of at least one of said star points, said cam surface acting directly against a cartridge's flange to bias that cartridge into a capture position with a cartridge bore as said latch rotates from said release position to said capture position.

26. A cartridge loader as set forth in claim 25, each of said star points having a cam surface on the leading edge thereof.

* * * * *